US009242756B2

(12) United States Patent
Yourist et al.

(10) Patent No.: US 9,242,756 B2
(45) Date of Patent: Jan. 26, 2016

(54) CONTAINER WITH BEND RESISTANT GRIPPABLE DOME

(71) Applicant: GRAHAM PACKAGING COMPANY, L.P., York, PA (US)

(72) Inventors: Sheldon E. Yourist, York, PA (US); Travis A. Hunter, Manchester, PA (US); Raymond A. Pritchett, Jr., Manchester, PA (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 0 days.

(21) Appl. No.: 13/836,957

(22) Filed: Mar. 15, 2013

(65) Prior Publication Data

US 2013/0200037 A1 Aug. 8, 2013

Related U.S. Application Data

(63) Continuation-in-part of application No. 12/784,658, filed on May 21, 2010.

(51) Int. Cl.

| | |
|---|---|
| ***B65D 1/02*** | (2006.01) |
| ***B65D 23/10*** | (2006.01) |
| ***B65D 1/44*** | (2006.01) |

(52) U.S. Cl.

CPC ..... *B65D 1/0223* (2013.01); *B65D 1/44* (2013.01); *B65D 23/102* (2013.01)

(58) Field of Classification Search

CPC ..... B65D 1/0223; B65D 1/42; B65D 1/44; B65D 1/0207; B65D 1/02; B65D 23/102

USPC ..... 215/382, 381, 383; 220/675, 62, 62.11, 220/600

See application file for complete search history.

(56) References Cited

U.S. PATENT DOCUMENTS 3,225,950 A 12/1965 Josephsen et al.
4,170,622 A * 10/1979 Uhlig ..... 264/520

(Continued)

FOREIGN PATENT DOCUMENTS

JP 7-07633 3/1995

OTHER PUBLICATIONS

U.S. Appl. No. 12/784,658, Jun. 16, 2014 Non-Final Office Action.

(Continued)

*Primary Examiner* — Stephen Castellano
(74) *Attorney, Agent, or Firm* — Baker Botts L.L.P.

(57) ABSTRACT

A hot fill type plastic container includes a finish, a bottom and a main body that is generally rectangular in transverse cross-section. The main body has an upper dome portion, a lower label portion and a waist groove defined between the upper dome portion and the lower label portion. Both the upper dome portion and the lower label portion have front and rear surfaces as well as opposing side surfaces that are narrower than the front and rear surfaces. The opposing side surfaces of the upper dome portion have a substantially vertically oriented reinforcing element defined therein that is recessed with respect to the surrounding sidewall of the upper dome portion. The reinforcing element extends into the waist groove, which increases the flexibility of the dome portion above the waist groove and protects the dome portion against damage as a result of contact with other containers during the filling and packaging processes.

22 Claims, 11 Drawing Sheets

(56) References Cited

U.S. PATENT DOCUMENTS

| | | | | |
|---|---|---|---|---|
| 5,637,167 | A | 6/1997 | Krishnakumar et al. | |
| 6,161,713 | A | 12/2000 | Krich | |
| D452,444 | S | 12/2001 | Iizuka et al. | |
| D459,234 | S | 6/2002 | Bourque et al. | |
| 6,398,052 | B1 | 6/2002 | Cheng et al. | |
| 6,494,333 | B2 | 12/2002 | Sasaki et al. | |
| 6,575,321 | B2 | 6/2003 | Bourque et al. | |
| 6,974,047 | B2 * | 12/2005 | Kelley et al. | 215/381 |
| 7,004,342 | B2 | 2/2006 | Bourque et al. | |
| D527,272 | S | 8/2006 | Lovelace et al. | |
| D530,212 | S | 10/2006 | Darr et al. | |
| 7,350,658 | B2 | 4/2008 | Bourque et al. | |
| 7,455,189 | B2 | 11/2008 | Lane et al. | |
| 2005/0045645 | A1 | 3/2005 | Tsutsui et al. | |
| 2005/0092708 | A1 | 5/2005 | Heisner et al. | |
| 2005/0211660 | A1 | 9/2005 | Galownia et al. | |
| 2006/0175284 | A1 | 8/2006 | Noll et al. | |
| 2007/0170144 | A1 * | 7/2007 | Lane et al. | 215/383 |
| 2007/0187354 | A1 | 8/2007 | Sasaki | |
| 2009/0266786 | A1 | 10/2009 | Sasaki | |
| 2010/0006535 | A1 | 1/2010 | Ogg | |
| 2011/0284493 | A1 | 11/2011 | Yourist et al. | |

OTHER PUBLICATIONS

U.S. Appl. No. 12/784,658, Jan. 15, 2013 Amendment and Request for Continued Examination (RCE).
U.S. Appl. No. 12/784,658, Jul. 25, 2012 Final Office Action.
U.S. Appl. No. 12/784,658, May 21, 2012 Response to Non-Final Office Action.
U.S. Appl. No. 12/784,658, Feb. 21, 2012 Non-Final Office Action.
International Search Report for PCT/US2011/036963, dated Jul. 4, 2011.
U.S. Appl. No. 12/784,658, Feb. 3, 2015.

* cited by examiner

CONTAINER WITH BEND RESISTANT GRIPPABLE DOME

This is a continuation-in-part of Ser. No. 12/784,658, filed May 21, 2010, the entire disclosure of which is hereby incorporated by reference as if set forth fully herein.

BACKGROUND OF THE INVENTION

1. Field of the Invention

This invention relates to blow molded plastic containers, and particularly those containers having an upper dome or bell portion that is designed to be gripped by a consumer during use.

2. Description of the Related Technology

Many products that were previously packaged using glass containers are now being supplied in plastic containers, such as containers that are fabricated from polyesters such as polyethylene terephthalate (PET).

PET containers are typically manufactured using the stretch blow molding process. This involves the use of a preform that is injection molded into a shape that facilitates distribution of the plastic material within the preform into the desired final shape of the container. The preform is first heated and then is longitudinally stretched and subsequently inflated within a mold cavity so that it assumes the desired final shape of the container. As the preform is inflated, it takes on the shape of the mold cavity. The polymer solidifies upon contacting the cooler surface of the mold, and the finished hollow container is subsequently ejected from the mold.

The use of blow molded plastic containers for the purpose of packaging liquids that are processed by the hot fill and/or pasteurization processes has been known for some time. The hot fill process involves filling the containers while the liquid product is at an elevated temperature, typically 68° C. to 96° C. (155° F.-205° F.) and usually about 85° C. (185° F.) in order to sterilize the container at the time of filling. Containers that are designed to withstand the hot fill process are known as "hot fill" or "heat set" containers. Such containers are typically designed with sidewalls that include one or more recessed vacuum panels that are designed to flex due to the temperature changes and consequent volumetric expansion and contraction that takes place during processing. In many instances, the recessed vacuum panels also provide convenient handholds that facilitate gripping of the container by consumers.

One type of conventional container design includes a lower portion that is shaped to receive a label and an upper dome or bell portion that is separated from the lower label portion by a waist. In some instances, the dome is constructed to extend outwardly from a longitudinal axis of the container to a greater extent than the label portion so that container to container contact during filling and packaging will occur between the respective dome portions, protecting the label portions against flexure that could cause delamination of the label. This is known in the industry as label protection.

The label portion may be constructed to flex inwardly during the hot fill process in a controlled fashion to adjust for volumetric changes within the container. However creasing or other significant shape changes are undesirable because of the need to provide label support. The waist of the container structurally isolates the dome portion from the label portion so that flexure in one will not be transmitted to the other. It also provides reinforcement against flexure of both the dome portion and the label portion. The amount of reinforcement provided to the label portion and the dome portion by the waist in conventional designs has tended to be about same.

However, in some instances it would be desirable to provide more reinforcement to the label portion. One reason for this is that in the past, it has been found to be difficult as a matter of design to provide effective gripping recesses within a dome or bell portion while maintaining material costs at an economically acceptable level, because the force created by a consumer while gripping the container has the tendency to collapse portions of the dome or bell portion. In addition, containers of this type may experience damage such as creasing as a result of container-to-container contact on the filling line.

A need exists for an improved plastic container having an upper dome or bell portion that is designed to be gripped by a consumer during use, which provides improved optimization of structural stability and material costs with respect to conventional designs.

SUMMARY OF THE INVENTION

Accordingly, it is an object of the invention to provide an improved plastic container having an upper dome or bell portion that is designed to be gripped by a consumer during use, which provides improved optimization of structural stability and material costs with respect to conventional designs.

In order to achieve the above and other objects of the invention, a plastic container according to a first aspect of the invention includes a finish, a bottom and a main body that is generally rectangular in transverse cross-section. The main body has an upper dome portion, a lower portion and a waist groove defined between the upper dome portion and the lower portion. The upper dome portion has a substantially vertically oriented reinforcing element defined therein. The substantially vertically oriented reinforcing element extends into the waist groove.

A plastic container according to a second aspect of the invention includes a finish, a bottom and a main body that is generally rectangular in transverse cross-section. The main body has an upper dome portion, a lower label portion and a waist groove defined between the upper dome portion and the lower label portion. Both the upper dome portion and the lower label portion have front and rear surfaces as well as opposing side surfaces that are narrower than the front and rear surfaces. The opposing side surfaces of the upper dome portion have a substantially vertically oriented reinforcing element defined therein that is recessed with respect to the surrounding sidewall of the upper dome portion. The reinforcing element extends into the waist groove, which increases the flexibility of the dome portion above the waist groove and protects the dome portion against damage as a result of contact with other containers during the filling and packaging processes.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
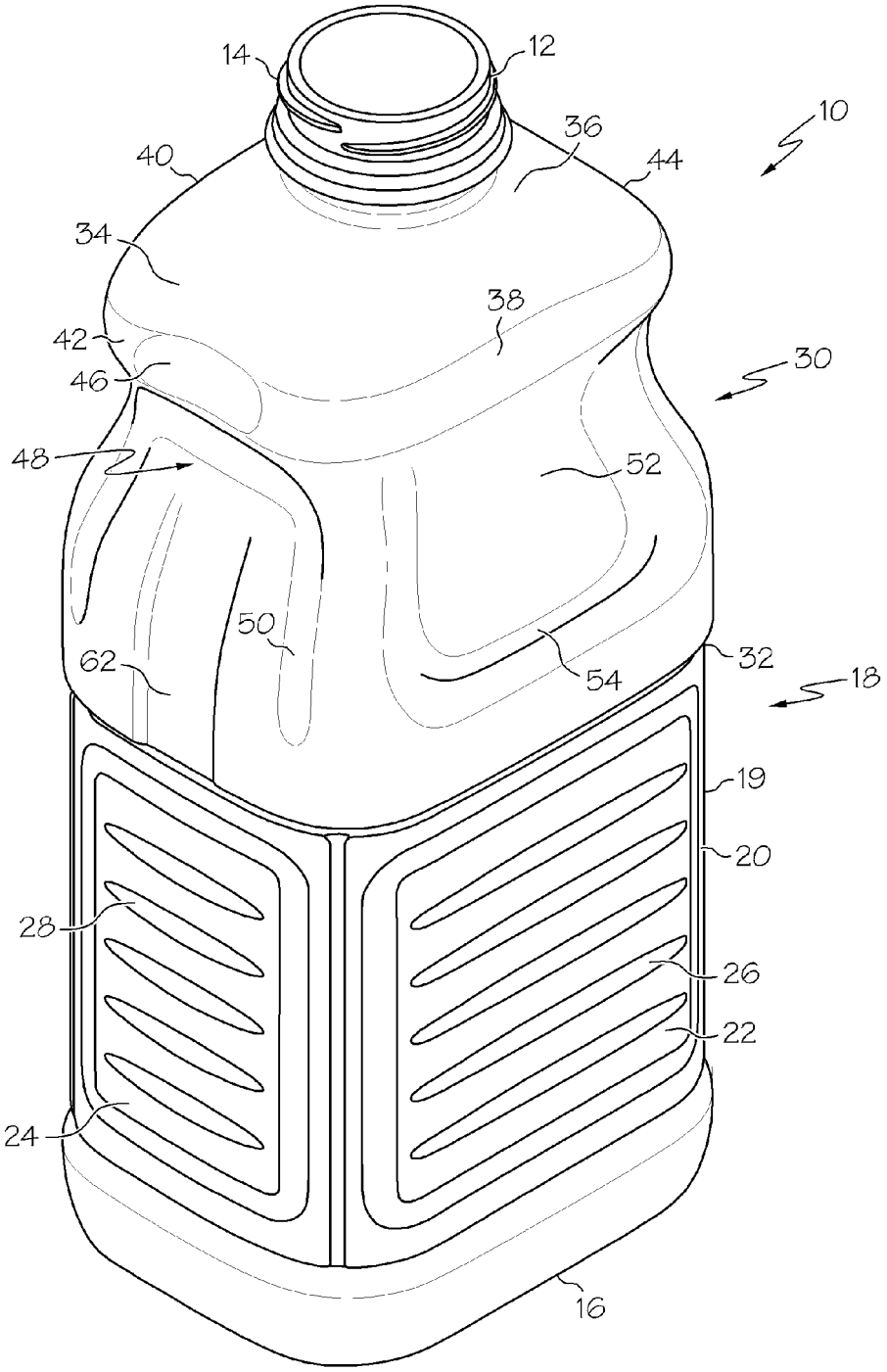
FIG. 1 is a perspective view of a plastic container that is constructed according to a preferred embodiment of the invention.
Figure 2:
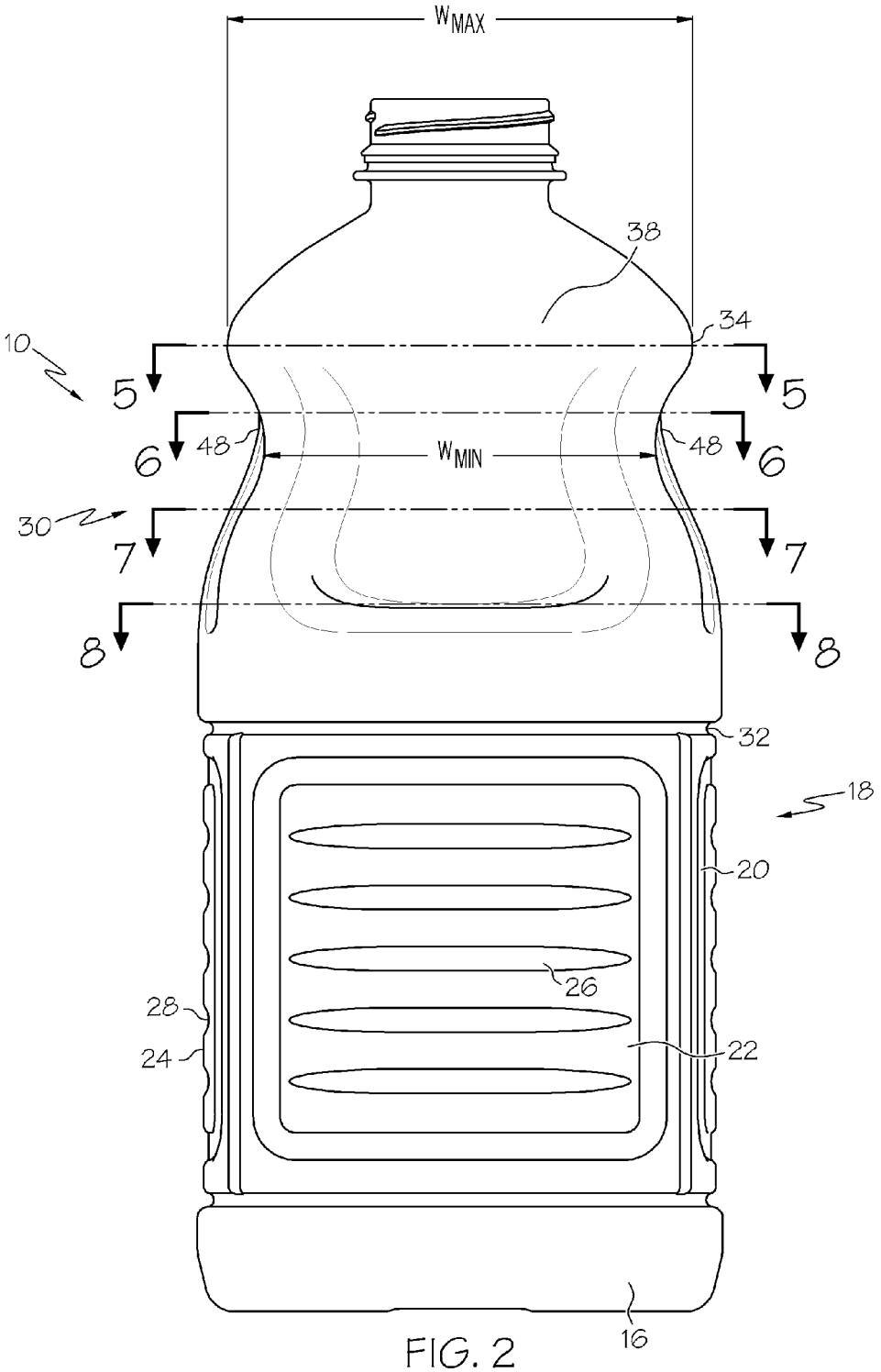
FIG. 2 is a front elevational view of the container that is shown in FIG. 1.

Referring now to the drawings, wherein like reference numerals designate corresponding structure throughout the views, and referring in particular to FIG. 1, a plastic container 10 that is constructed according to a preferred embodiment of the invention is preferably fabricated from a material such as polyethylene terephthalate (PET) from a preform using a conventional reheat stretch blow molding process. Plastic container 10 is preferably, although not necessarily, constructed for hot fill applications.

In the embodiment that is shown in FIG. 1, plastic container 10 includes a threaded finish 12 having one or more threads 14 defined thereon, to which a conventional closure cap or dispensing cap may be secured. Plastic container 10 further preferably includes a bottom portion 16 and a main body portion 18 having a thin plastic sidewall 19 that is unitary with the finish 12 and the bottom portion 16.

As FIG. 1 shows, the main body portion 18 includes a lower portion 20 that is preferably substantially rectangular in horizontal cross-section. Lower portion 20 preferably includes front and rear panels 22 and side panels 24 that are narrower than the front and rear panels 22. In the preferred embodiment, a plurality of horizontally oriented reinforcement grooves or inwardly extending ribs 26 are defined in the front and back panels 22. Similar horizontally oriented reinforcement grooves or inwardly extending ribs 28 are also preferably defined in the side panels 24. The presence of the inwardly extending grooves or ribs 26, 28 enhances the structural stability of the lower portion 20, especially during the vacuum uptake phase of the hot fill process.

The main body portion 18 also preferably includes an upper dome or bell 30 that is separated from the lower portion 20 by a waist 32. In the illustrated embodiment, the waist 32 is embodied as a peripheral inwardly extending groove, but an alternative embodiments it may be more or less pronounced or it may simply be an interface between the upper dome 30 and the lower portion 20.

Figure 4:
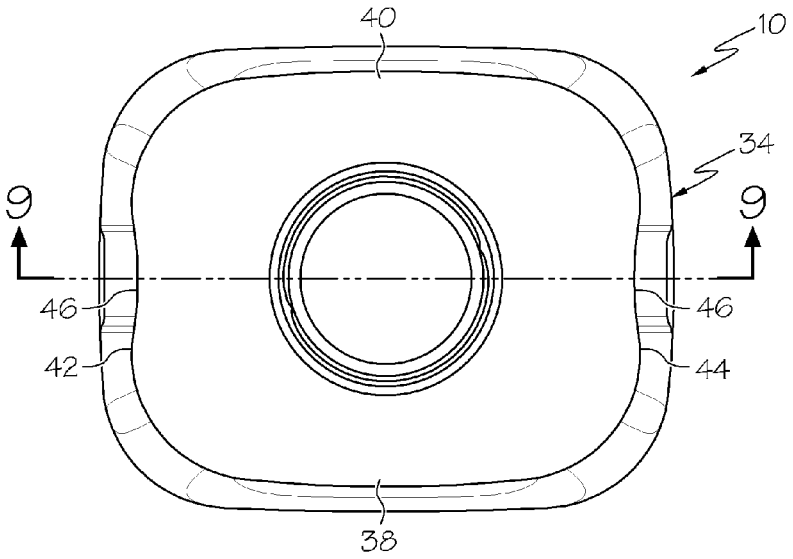
FIG. 4 is a top plan view of the container that is shown in FIG. 1.
Figure 5:
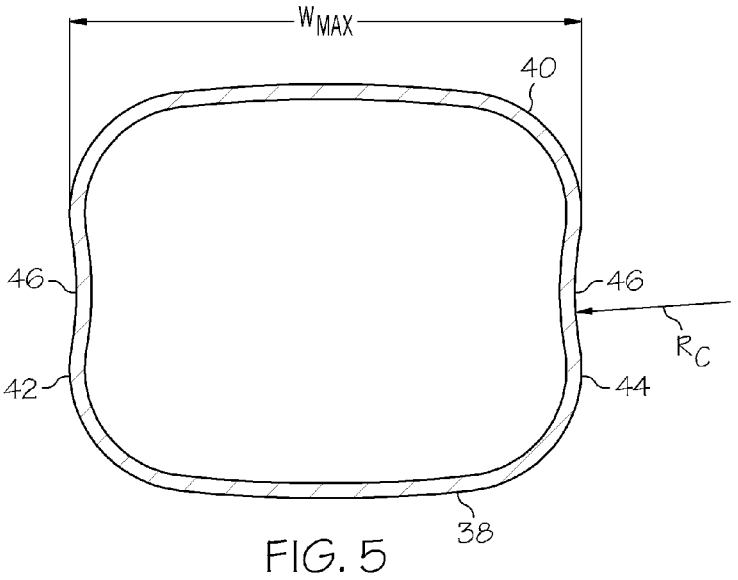
FIG. 5 is a cross-sectional view taken along lines 5-5 in FIG. 2.
Figure 6:
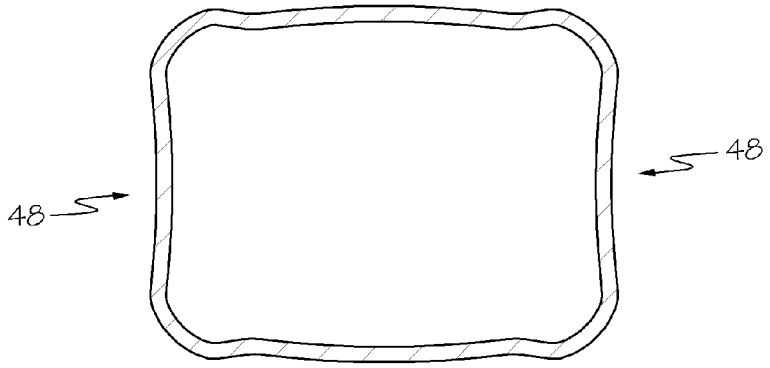
FIG. 6 is a cross-sectional view taken along lines 6-6 in FIG. 2.
Figure 7:
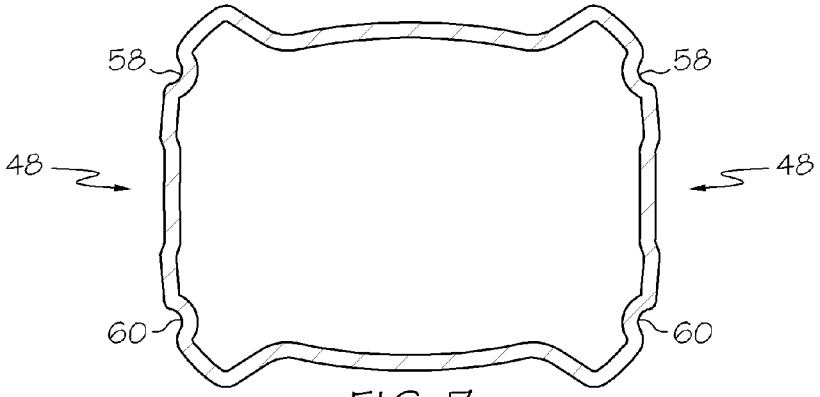
FIG. 7 is a cross-sectional view taken along lines 7-7 in FIG. 2.

The upper dome 30 preferably includes an upper brow portion 34 that is shaped so as to substantially approximate a rounded rectangle when viewed in top plan, as is shown in FIG. 4. In the preferred embodiment, the upper brow portion 34 has a generally bulbous shape and includes a rounded upper surface 36 that forms an upper shoulder of the container 10 and is integral with the finish 12. The upper brow portion 34 further includes a first pair of sides, namely front and rear sides 38, 40 that have a first width, and a second, lateral pair of sides 42, 44 having a second width that is less than the first width. The upper brow portion 34 has a first maximum width $W_{MAX}$, as is best shown in FIG. 5.

In this embodiment, a concave recess 46 is defined in each of the lateral sides 42, 44 of the upper brow portion 34. Alternatively, the concave recess 46 may be defined in only one of the lateral sides 42, 44. Preferably, each concave recess 46 is substantially centered vertically and horizontally with respect to the lateral side 42, 44 in which it is defined. Each of the concave recesses 46 preferably intersects a horizontal plane that also intersects portions of the upper brow portion 34 that define the first maximum width $W_{MAX}$. The presence of the concave recesses 46 provides significant additional structural stability to the upper brow portion 34 when the container 10 is gripped by a consumer during use. Preferably, both of the concave recesses 46 have a radius of curvature $R_C$, and a ratio of $R_C/W_{MAX}$ is preferably within a range of about 0.95 to about 0.99.

Directly beneath the lateral sides 42, 44 of the upper brow portion 34 are defined first gripping recesses 48 for facilitating gripping of the container 10 by a consumer. In the preferred embodiment, the structural stability of each of the gripping recesses 48 is enhanced by the presence of an inverted U-shaped groove 50, as may best be seen in FIGS. 1 and 3. The inverted U-shaped groove 50 includes a substantially horizontal upper portion 56 and first and second downwardly extending leg portions 58, 60. The substantially horizontal upper portion 56 is preferably directly beneath the lateral side 42, 44 of the upper brow portion 34 and therefore directly beneath the concave recess 46. The juxtaposition of the concave recess 46 and the horizontal upper portion 56 of the U-shaped groove 50 creates a sharp undercut and a tightly radiused transition portion that both enhances grippability of the container 10 and provides significant reinforcement against deformation when the container 10 is gripped by a consumer, without requiring significant additional material during the fabrication process.

The upper dome 30 also preferably includes second gripping recesses 52 that are defined directly beneath the front and rear sides 38, 40 of the upper brow portion 34. The portions of the sidewall 19 defining the second gripping recesses 52 each have a U-shaped groove 54 defined therein for providing additional structural stability when the container 10 is gripped by a consumer. In this embodiment, the uppermost and lowermost extents of the U-shaped groove 54 are both substantially the same as that of the U-shaped groove 50 that is defined in the portion of the sidewall 19 that defines the first gripping recesses 48. The U-shaped groove 54 is also preferably substantially centered with respect to both the second gripping recess 52 and the front or rear side 38, 40 of the upper brow portion 34 that is positioned directly above it.

Figure 8:
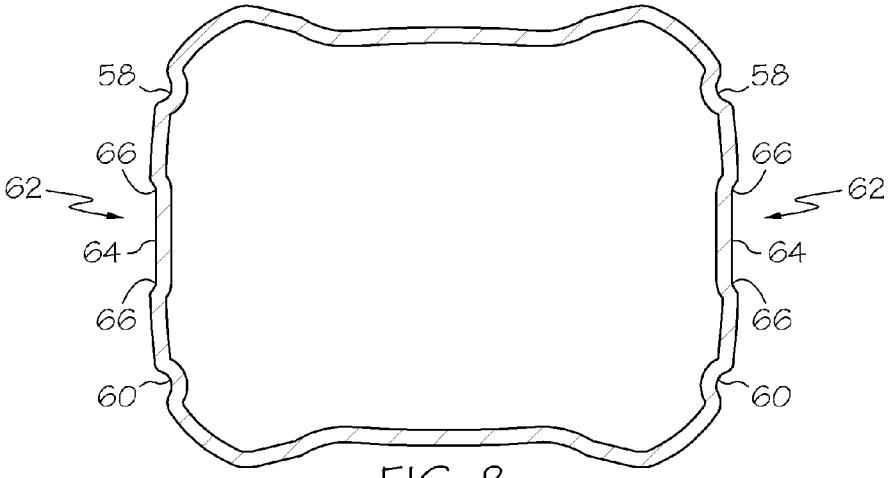
FIG. 8 is a cross-sectional view taken along lines 8-8 in FIG. 2.
Figure 9:
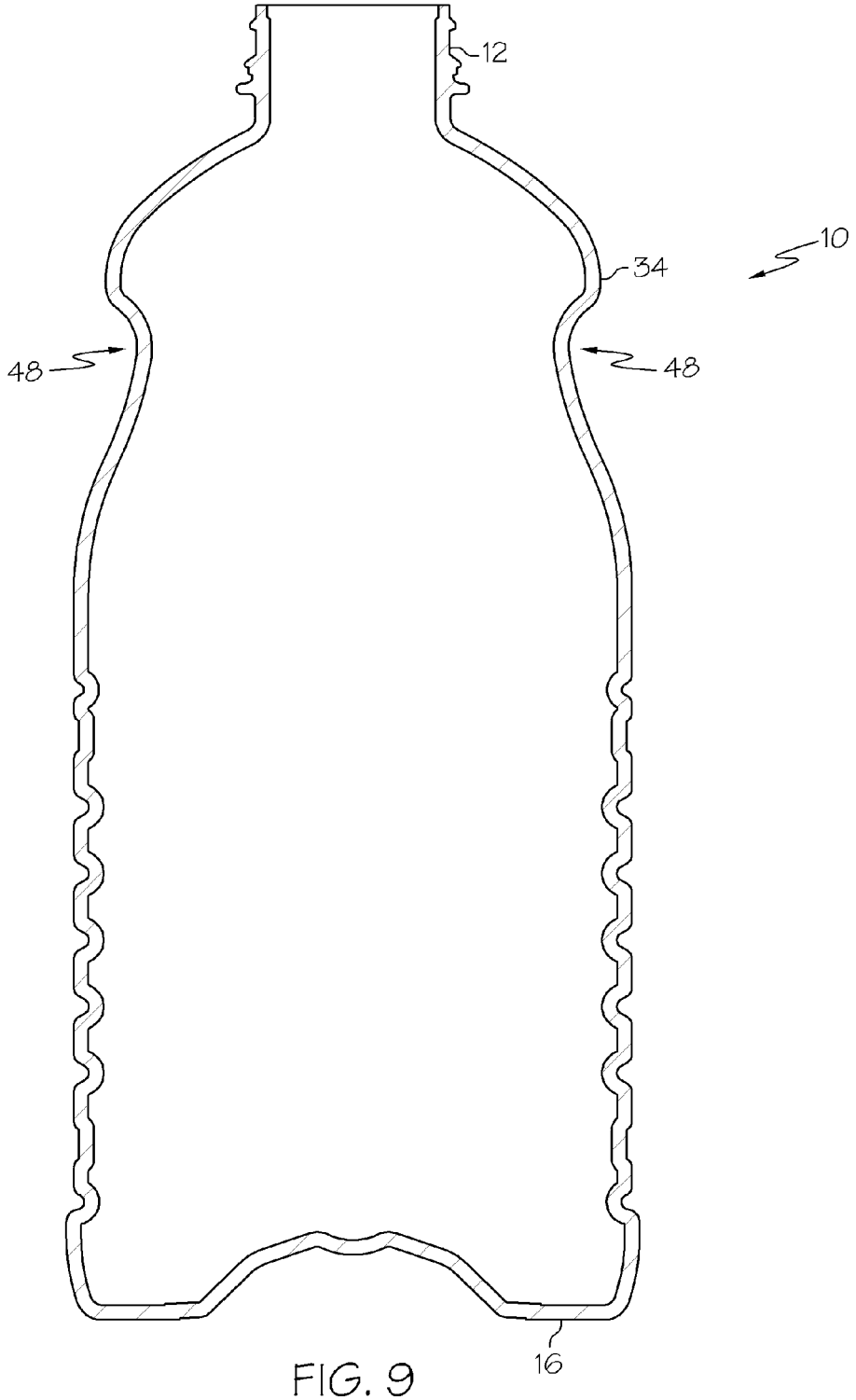
FIG. 9 is a cross-sectional view taken along lines 9-9 in FIG. 4.

The portion of the sidewall 19 that defines each of the first gripping recesses 48 is also preferably provided with a vertically oriented reinforcing element 62 that is separate from the inverted U-shaped groove 50. In the preferred embodiment, the vertically oriented reinforcing element 62 includes a vertically oriented recessed band or groove having a substantially flat bottom surface 64 and a pair of edge portions 66 connecting the substantially flat bottom surface 64 to the rest of the sidewall 19 that defines the first gripping recesses 48, as is shown in cross-section in FIG. 8.

The presence of the vertically oriented reinforcing element 62 provides significant additional structural reinforcement against deformation of the portion of the sidewall 19 that defines the first gripping recesses 48, acting in conjunction with the structural reinforcement that is provided by the U-shaped groove 50 and by the presence of the concave recess 46.

Figure 3:
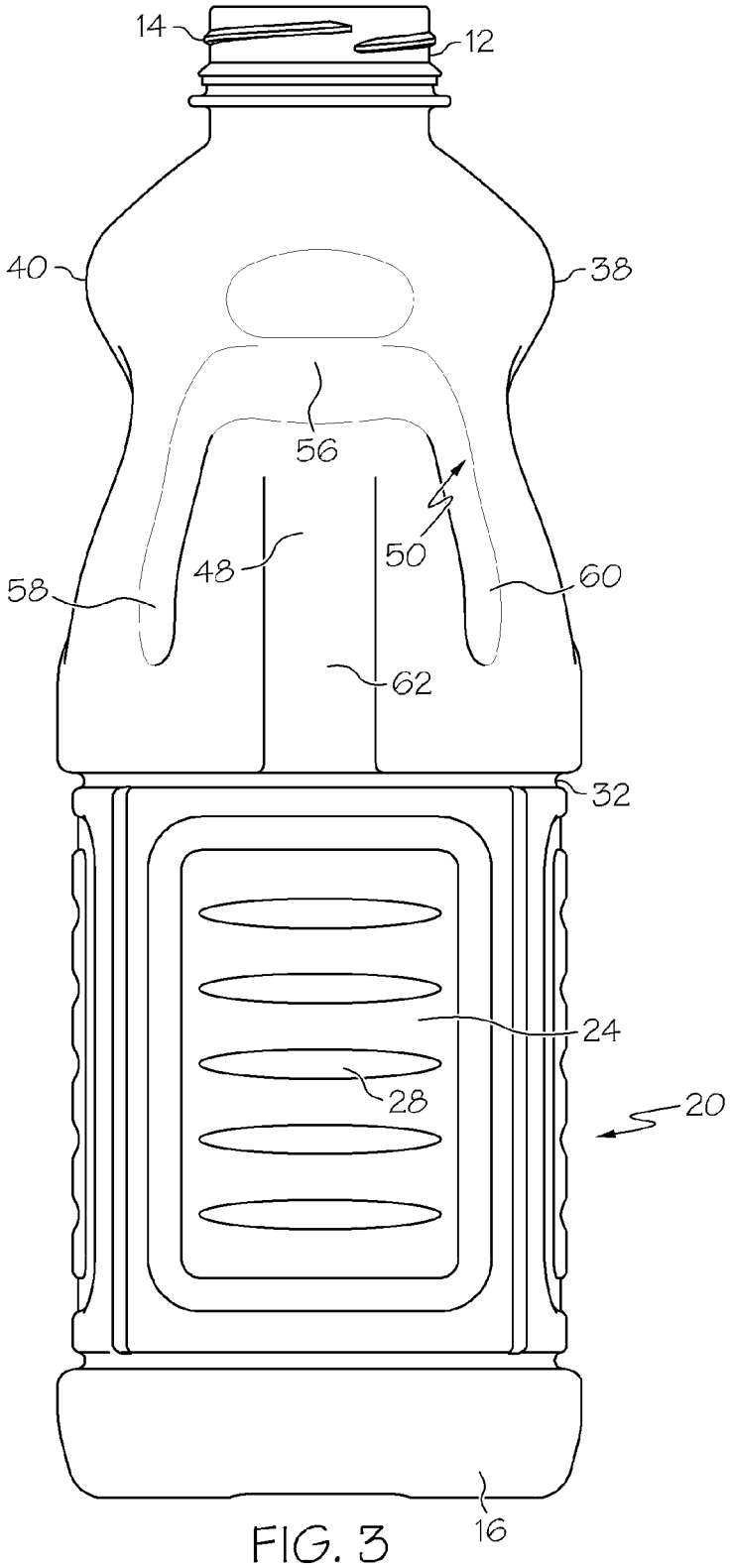
FIG. 3 is a side elevational view of the container that is shown in FIG. 1.
Figure 10:
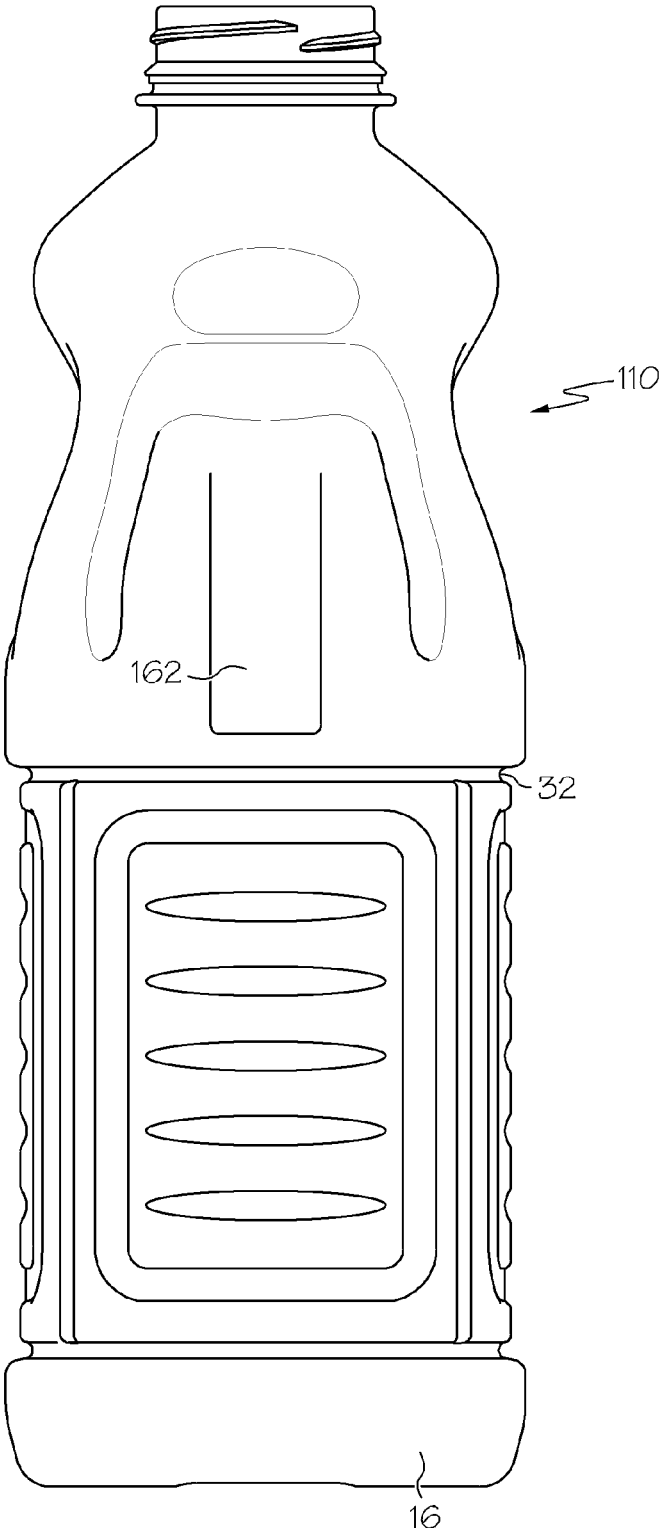
FIG. 10 is a side elevational view of a container that is constructed according to an alternative embodiment.
Figure 11:
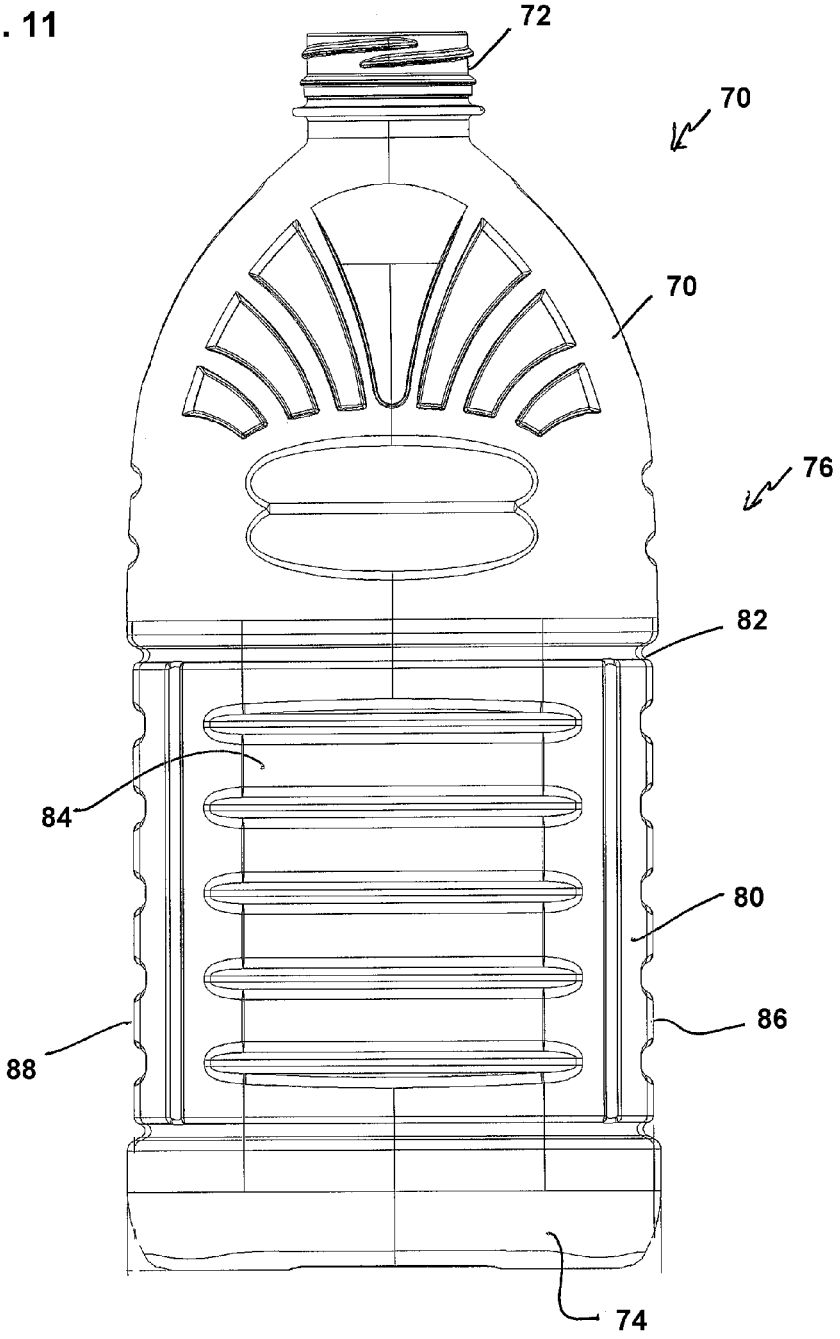
FIG. 11 is a front elevational view of a container that is constructed according to an alternative embodiment of the invention.

In the embodiment shown in FIG. 3, the vertically oriented reinforcing element 62 is constructed to extend to the bottom of the upper dome or bell 30 and to the waist 32. However, in an alternative embodiment of the invention that is shown in FIG. 10, a container 110 is constructed so that the bottom of the vertically oriented reinforcing element 162 is above the bottom of the upper dome or bell 30 and the waist 32.

The vertically oriented reinforcing element 62 preferably extends substantially all the way to the bottom of the upper dome 30 to the waist 32. The vertically oriented reinforcing element is also preferably substantially centered when viewed in side elevation with respect to the downwardly extending legs 58, 60 of the U-shaped groove 50.

A plastic container 70 that is constructed according to an alternative embodiment of the invention is depicted in FIGS. 11-15. Plastic container 70 includes a finish portion 72, a bottom 74 and a main body 76 that is generally rectangular in transverse cross-section, as may be seen in FIG. 14. The plastic container 70 is accordingly what the industry terms a rectangular container. Such containers present different structural and engineering issues than plastic containers that are generally cylindrical in shape. Like the container 10 that was described with respect to the first embodiment, the plastic container 70 is preferably fabricated from a material including polyethylene terephthalate using a standard reheat stretch blow molding process.

The main body portion 76 includes an upper dome portion 78 and a lower label portion 80 that is provided with panels that are designed to support a label and to flex inwardly in a controlled fashion in order to accommodate the internal volumetric changes that are associated with the hot fill process. Specifically, the main body portion 76 includes a front panel surface 84, first and second side panel surfaces 86, 88 and a rear panel surface 90. In the preferred embodiment, the first and second side panels 86, 88 are preferably substantially symmetrical to each other and the front and rear panel surfaces 84, 90 are also preferably constructed to have features that substantially mirror each other.

A waist groove 82 is preferably defined between the upper dome portion 78 and the lower label portion 80. The waist groove 82 preferably extends about the circumference of the main body 76 and provides reinforcement against flexure to both the upper dome portion 78 and the lower label portion 80. However, as will be discussed in greater detail below, the reinforcement against flexure of the side panels 86, 88 of the upper dome portion 78 is intentionally limited in order to permit the side portions of the upper dome portion 78 to flex when the container 70 is contacted by like containers on a filling line. This protects the container 70 against damage that could otherwise be caused by such contact.

The waist groove 82 also provides structural isolation between the upper dome portion 78 and the lower label portion 80, so that flexure in one of the portions will be attenuated before it causes flexure in the other portion.

Each of the side surfaces 86, 88 of the upper dome portion 78 advantageously includes a substantially vertically oriented reinforcing element 92 that reinforces the side surface of the dome portion 78 against forces and impacts that may be caused by contact with a like container on a filling line or other mechanized transportation or packaging system for such containers. The substantially vertically oriented reinforcing element 92 includes an upper portion 94 and a lower portion 96 that extends into the waist groove 82. Alternatively, only one of the side surfaces 86, 88 could be provided with the substantially vertically oriented reinforcing element 92.

Figure 15:
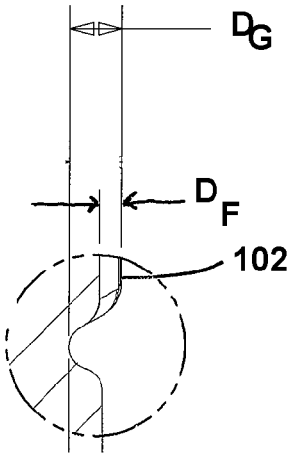
FIG. 15 is an enlarged fragmentary cross-sectional view depicting the area within the circle 15-15 in FIG. 13.

The reinforcing element 92 is preferably recessed by a first maximum distance DF with respect to a surrounding sidewall portion 102 of the upper dome portion 78. The waist groove 82 has a bottom surface adjacent to the reinforcing element 92 that defines a second maximum distance DG with respect to the surrounding sidewall 102, as is best shown in FIG. 15. A DF/DG ratio of the first maximum depth DF to the second maximum depth DG is preferably at least about 0.1, more preferably at least about 0.25 and most preferably at least about 0.4.

The surrounding sidewall portions 102 preferably extends laterally outwardly beyond the side panels that are located on the lower label portion 80 beneath the waist groove 82, so that container-to-container contact that may occur on the filling line or other mechanized transportation system will happen between the respective dome portion 78, with the label portions 80 being protected. As is typical with such containers, the bottom portion 74 may extend outwardly to the same extent as the dome portion 78 so that there is a lower point of contact between the containers that also extends outwardly beyond the label panel.

Because reinforcing element 92 penetrates into the waist groove 82, the amount of structural reinforcement that is imparted by the groove 82 to the side of the upper dome portion 78 near the reinforcing element 92 is reduced, increasing the amount of flexure that will take place when the side of the upper dome portion 78 is contacted by a like container. In addition, the recess that is defined by the inner-recessed, vertically-oriented, concave side surface 104 of the reinforcing element 92 will create two points of contact between like containers when contact occurs, which will spread out the transmission of force to the sidewalls of the respective containers.

Unlike the vertically oriented reinforcing element in the previously described embodiment, the vertically oriented reinforcing element 92 is shaped to have an inner-recessed, vertically-oriented, concave side surface 104, which preferably has a substantially constant radius of curvature RF. The inner-recessed, vertically-oriented, concave side surface of the reinforcing element 92 as it is viewed in transverse cross-section may also create a spring effect that will absorb some of the force that is imparted to the side surface of the upper dome 78 when contact with an adjacent container occurs.

Figure 12:
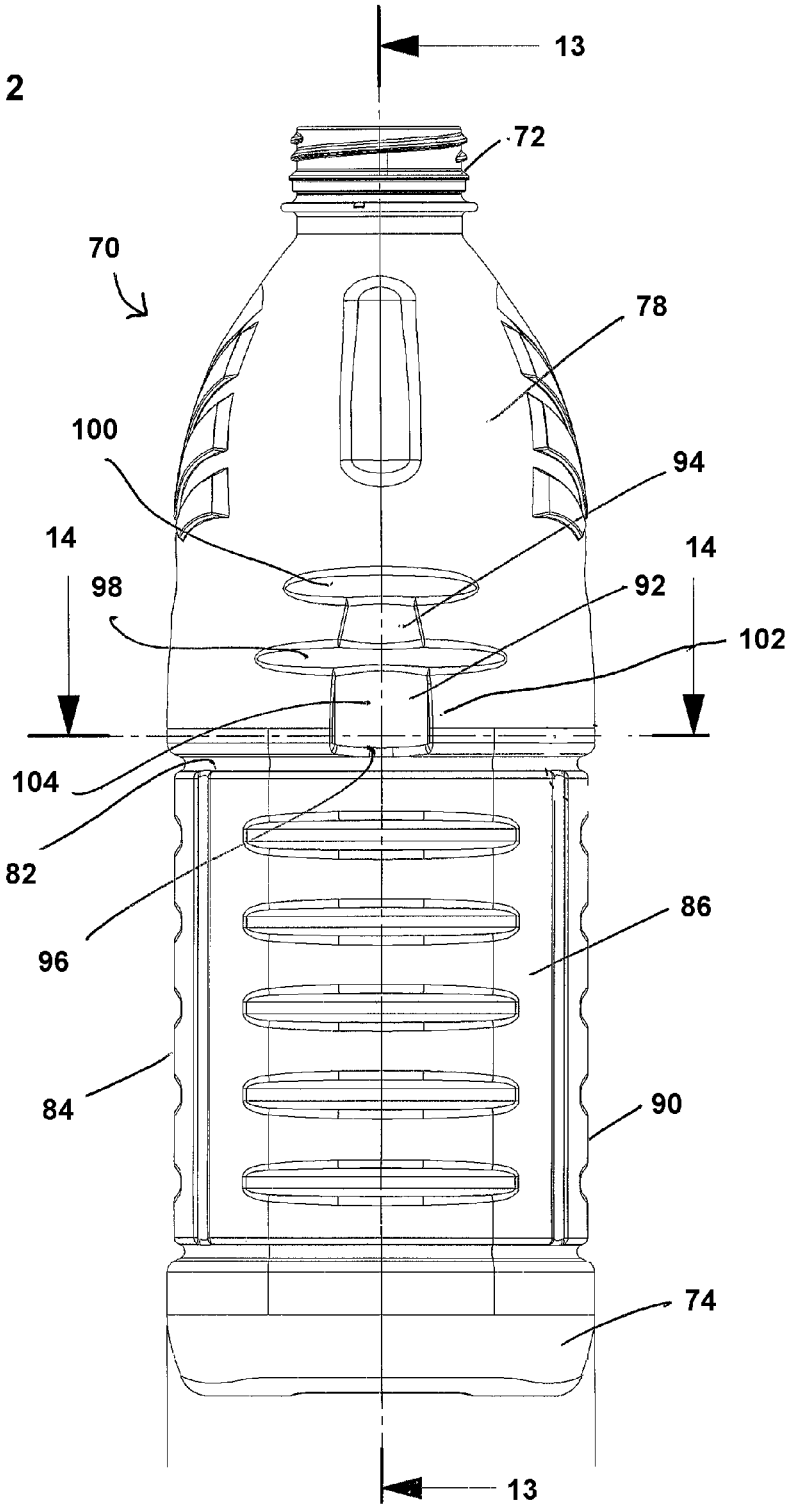
FIG. 12 is a side elevational view of the container that is depicted in FIG. 11.
Figure 13:
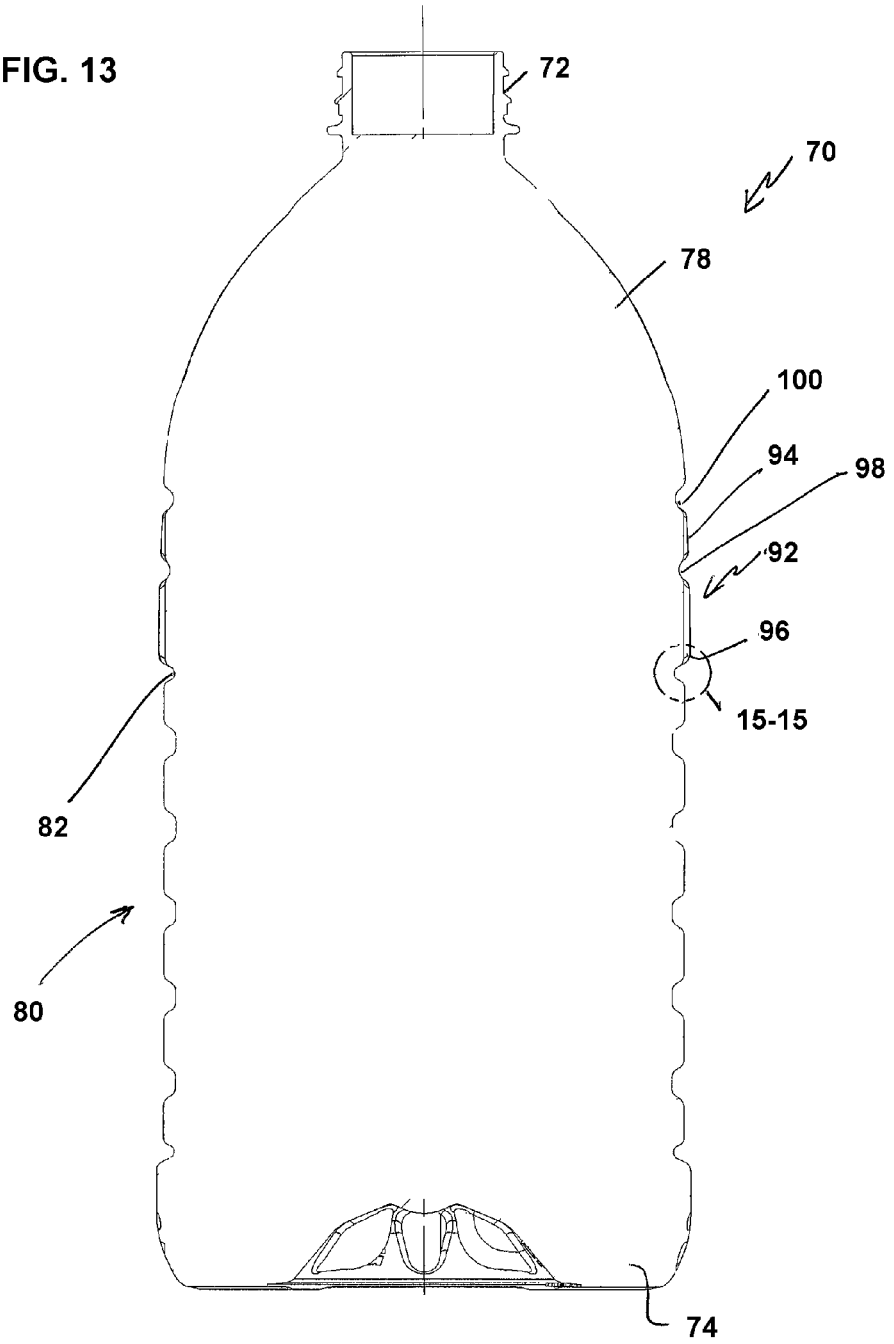
FIG. 13 is a cross-sectional view taken along lines 13-13 in FIG. 12.
Figure 14:
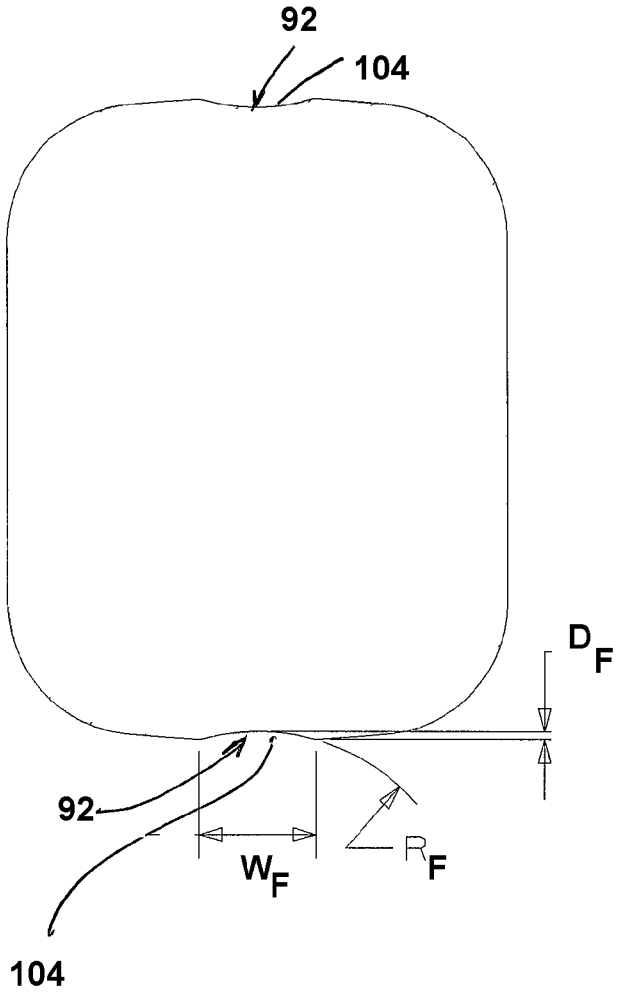
FIG. 14 is a cross-sectional view taken along lines 14-14 in FIG. 12.

As FIG. 12 shows, the substantially vertical reinforcing element 92 in the preferred embodiment is intersected by two horizontal grooves 98, 100. The grooves 98, 100 provide a measure of reinforcement against bending stresses in a direction that is orthogonal to the reinforcement that is provided by the reinforcing element 92. In the illustrated embodiment, the horizontal grooves 98, 100 are both slightly deeper than the substantially vertical reinforcing element 92.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A plastic container, comprising:

a finish portion;

a bottom; and a main body between the finish portion and the bottom, the main body being generally rectangular in transverse cross-section, the main body having an upper dome portion, a lower portion and a waist groove defined between the upper dome portion and the lower portion, wherein the upper dome portion has a substantially vertically oriented reinforcing element defined therein, the substantially vertically oriented reinforcing element being recessed with respect to a surrounding sidewall of the upper dome portion and extending into the waist groove, and further wherein the upper dome portion has at least one horizontal groove defined therein and intersecting the substantially vertically oriented reinforcing element with an upper portion of the substantially vertically oriented reinforcing element disposed above the at least one horizontal groove.

2. A plastic container according to claim 1, wherein the substantially vertically oriented reinforcing element comprises an inner-recessed, vertically-oriented, concave side surface.

3. The plastic container according to claim 2, wherein the concave side surface has a substantially constant radius of curvature.

4. A plastic container according to claim 1, wherein the substantially vertically oriented reinforcing element defines a first maximum depth with respect to the surrounding sidewall of the upper dome portion and wherein the waist goove beneath the substantially vertically oriented reinforcing element defines a second maximum depth with respect to the surrounding sidewall of the upper dome portion, and wherein a ratio of the first maximum depth to the second maximum depth is at least about 0.1.

5. A plastic container according to claim 4, wherein the ratio of the first maximum depth to the second maximum depth is at least about 0.25.

6. A plastic container according to claim 5, wherein the ratio of the first maximum depth to the second maximum depth is at least about 0.4.

7. A plastic container according to claim 1, wherein the upper dome portion has front and rear panels and opposing side panels that are narrower than the front and rear panels, and wherein the substantially vertically oriented reinforcing element is defined on at least one of the opposing side panels.

8. A plastic container according to claim 7, further comprising a second substantially vertically oriented reinforcing element defined in the other of the opposing side panels.

9. A plastic container according to claim 1, wherein the horizontal groove is deeper than the substantially vertically oriented reinforcing element where the horizontal groove intersects the substantially vertically oriented reinforcing element.

10. A plastic container according to claim 1, wherein the main body is fabricated from a material comprising polyethylene terephthalate.

11. A plastic container according to claim 1, wherein the plastic container is a hot fill type container.

12. A plastic container according to claim 1, wherein the surrounding sidewall of the upper dome portion adjacent to the substantially vertically oriented reinforcing element extends laterally outwardly beyond a sidewall of the lower portion beneath the respective upper dome portions, whereby contact between adjacent containers on a filling line will occur primarily between the respective upper dome portions.

13. The plastic container according to claim 1, wherein the at least one horizontal groove comprises a first horizontal groove and a second horizontal groove, and wherein the upper portion of the substantially vertically oriented reinforcing element is disposed between the first horizontal groove and the second horizontal groove.

14. A hot fill type plastic container, comprising:

a finish portion;

a bottom; and a main body between the finish portion and the bottom, the main body being generally rectangular in transverse cross-section, the main body having an upper dome portion, a lower label portion and a waist groove defined between the upper dome portion and the lower label portion, both the upper dome portion and the lower label portion having front and rear surfaces and opposing side surfaces that are narrower than the front and rear surfaces, wherein each of the opposing side surfaces of the upper dome portion has a substantially vertically oriented reinforcing element defined therein, each substantially vertically oriented reinforcing element being recessed with respect to a surrounding sidewall of the upper dome portion and extending into the waist groove, and further wherein the upper dome portion has a horizontal groove defined therein intersecting at least one of the substantially vertically oriented reinforcing elements with an upper portion of the substantially vertically oriented reinforcing element disposed above the at least one horizontal groove.

15. A hot fill type plastic container according to claim 14, wherein the substantially vertically oriented reinforcing element comprises an inner-recessed, vertically-oriented, concave side surface.

16. The plastic container according to claim 15, wherein the concave side surface has a substantially constant radius of curvature.

17. A hot fill type plastic container according to claim 14, wherein the substantially vertically oriented reinforcing element defines a first maximum depth with respect to the surrounding sidewall of the upper dome portion and wherein the waist groove beneath the substantially vertically oriented reinforcing element defines a second maximum depth with respect to the surrounding sidewall of the upper dome portion, and wherein a ratio of the first maximum depth to the second maximum depth is at least about 0.1.

18. A plastic container according to claim 17, wherein the ratio of the first maximum depth to the second maximum depth is at least about 0.25.

19. A plastic container according to claim 18, wherein the ratio of the first maximum depth to the second maximum depth is at least about 0.4.

20. A plastic container according to claim 14, wherein the horizontal groove is deeper than the at least one of the substantially vertically oriented reinforcing elements where the horizontal groove intersects the substantially vertically oriented reinforcing element.

21. A plastic container according to claim 14, wherein the main body is fabricated from a material comprising polyethylene terephthalate.

22. The plastic container according to claim 14, wherein the at least one horizontal groove comprises a first horizontal groove and a second horizontal groove, and wherein the upper portion of the substantially vertically oriented reinforcing element is disposed between the first horizontal groove and the second horizontal groove.

* * * * *